US012066242B2

(12) United States Patent
Pacheco et al.

(10) Patent No.: US 12,066,242 B2
(45) Date of Patent: Aug. 20, 2024

(54) REFRIGERATING APPARATUS

(71) Applicant: ELECTROLUX DO BRASIL S.A., Curitiba (BR)

(72) Inventors: Gabriel Pacheco, Curitiba (BR); Wesley Saikawa, Curitiba (BR); Marcelo Furmann, Curitiba (BR); Ramom Eduardo Gadens Baduy, Curitiba (BR)

(73) Assignee: Electrolux do Brasil S. A., Curitiba (BR)

( * ) Notice: Subject to any disclaimer, the term of this patent is extended or adjusted under 35 U.S.C. 154(b) by 66 days.

(21) Appl. No.: 17/603,018

(22) PCT Filed: May 3, 2019

(86) PCT No.: PCT/BR2019/050165

§ 371 (c)(1),
(2) Date: Oct. 12, 2021

(87) PCT Pub. No.: WO2020/223772

PCT Pub. Date: Nov. 12, 2020

(65) Prior Publication Data

US 2022/0187009 A1 Jun. 16, 2022

(51) Int. Cl.

| | |
|---|---|
| ***F25D 23/04*** | (2006.01) |
| ***F25D 23/06*** | (2006.01) |
| ***F25D 25/02*** | (2006.01) |

(52) U.S. Cl.

CPC ..... *F25D 23/04* (2013.01); *F25D 23/067* (2013.01); *F25D 25/02* (2013.01)

(58) Field of Classification Search

CPC ..... F25D 23/067; F25D 25/021; F25D 25/02; F25D 31/007; F25D 2331/803;

(Continued)

(56) References Cited

U.S. PATENT DOCUMENTS

| | | | |
|---|---|---|---|
| 255,695 | A | 3/1882 | Taylor |
| 427,462 | A | 5/1890 | Crider |

(Continued)

FOREIGN PATENT DOCUMENTS

| | | | | |
|---|---|---|---|---|
| CN | 2903840 | Y * | 5/2007 | ..... F25D 23/04 |
| CN | 205784206 | U * | 12/2016 | |

(Continued)

OTHER PUBLICATIONS

Translation for WO2010112296 (Year: 2010).*

(Continued)

*Primary Examiner* — Hiwot E Tefera
(74) *Attorney, Agent, or Firm* — Pearne & Gordon LLP

(57) ABSTRACT

The refrigerating apparatus (100) comprises: a refrigerating compartment (105) delimited by a rear wall (105$_R$), and first (105s$_1$) and second (105s$_2$) side walls, a door (110) for closing the compartment (105) and facing the rear wall (105$_R$) when the door (110) is closed, a support element (135;235;335;435;535) within the compartment (105) for supporting an accessory (140,145), wherein the support element (135;235;335;435;535) comprises a rail being a separate part adapted to be fixedly mounted to or fixedly associated with one of the first (105$_{S1}$) and second (105$_{S2}$) side walls so as to extend along one of the first (105$_{S1}$) and second (105$_{S2}$) side walls, the rail adapted to receive at least partially the accessory (140,145) and to hang it in a cantilevered manner whereby the accessory (140,145) is allowed to be positioned along one of the first (105$_{S1}$) and second (105$_{S2}$) side walls in a cantilevered manner.

8 Claims, 8 Drawing Sheets

(58) Field of Classification Search
CPC ..... F25D 2331/805; F25D 2331/809; F25D 2500/02; F25D 23/04; F25D 23/065; F25D 23/066; A47B 96/067
See application file for complete search history.

(56) References Cited

U.S. PATENT DOCUMENTS

| | | | | |
|---|---|---|---|---|
| 3,409,260 | A | 11/1968 | Bleed | |
| 3,464,212 | A | 9/1969 | Yamagata | |
| 3,647,075 | A | 3/1972 | Aue | |
| 3,698,565 | A | 10/1972 | Weber | |
| 3,886,698 | A | 6/1975 | Raith | |
| 4,008,872 | A | 2/1977 | Thompson | |
| 4,174,486 | A | 11/1979 | Winkler | |
| 4,209,098 | A * | 6/1980 | Adams | A47F 5/0853 248/513 |
| 4,615,448 | A | 10/1986 | Johnstonbaugh | |
| 4,779,939 | A | 10/1988 | Stich | |
| 4,826,022 | A | 5/1989 | Duarte | |
| 5,018,323 | A | 5/1991 | Clausen | |
| 5,138,803 | A | 8/1992 | Grossen | |
| 5,323,917 | A * | 6/1994 | Johnson | F25D 25/02 211/74 |
| 5,549,379 | A * | 8/1996 | Jun | A47B 46/00 312/246 |
| 5,638,962 | A | 6/1997 | Price, Jr. | |
| 5,791,093 | A | 8/1998 | Diamond | |
| 6,085,542 | A | 7/2000 | Johnson | |
| 6,582,038 | B2 | 6/2003 | Moreno-Olguin et al. | |
| 7,300,120 | B2 | 11/2007 | Shin | |
| D589,728 | S | 4/2009 | Shaha et al. | |
| 7,748,805 | B2 | 7/2010 | Lucas et al. | |
| 7,766,437 | B2 | 8/2010 | Lim et al. | |
| 7,798,339 | B2 | 9/2010 | Brooks et al. | |
| 7,992,728 | B2 | 8/2011 | Burgess et al. | |
| 9,389,012 | B2 | 7/2016 | Rackley et al. | |
| 9,874,393 | B2 | 1/2018 | Rackley et al. | |
| 2004/0149669 | A1 | 8/2004 | Tomonari et al. | |
| 2007/0085457 | A1* | 4/2007 | Park | F25D 25/025 312/402 |
| 2007/0159041 | A1 | 7/2007 | Lucas et al. | |
| 2007/0228242 | A1* | 10/2007 | Martin | F25D 25/02 211/74 |
| 2008/0231159 | A1 | 9/2008 | Lee et al. | |
| 2012/0024006 | A1* | 2/2012 | Knoll | F25D 25/021 62/465 |
| 2013/0081421 | A1 | 4/2013 | Kwon et al. | |
| 2014/0360220 | A1* | 12/2014 | Rackley | F25D 23/04 62/377 |
| 2016/0123655 | A1* | 5/2016 | Chow | F25D 23/067 312/405 |
| 2018/0216874 | A1* | 8/2018 | Pinheiro | F25D 23/04 |
| 2018/0224192 | A1 | 8/2018 | Baker et al. | |
| 2019/0178566 | A1* | 6/2019 | Cordero | F25D 11/02 |
| 2019/0331405 | A1* | 10/2019 | Bialas | A47J 45/00 |

FOREIGN PATENT DOCUMENTS

| | | | | |
|---|---|---|---|---|
| CN | 107923697 | A * | 4/2018 | F25D 23/04 |
| DE | 102013220081 | A1 * | 4/2015 | F25D 25/02 |
| EP | 0707184 | | 4/1996 | |
| EP | 2666388 | A1 * | 11/2013 | F25D 23/04 |
| GB | 2203028 | | 10/1988 | |
| JP | 2003279240 | | 10/2003 | |
| JP | 2003279240 | A * | 10/2003 | |
| KR | 19990017785 | U * | 6/1999 | F25D 23/00 |
| KR | 19990019489 | U * | 6/1999 | |
| KR | 0128426 | Y1 * | 10/1999 | F25D 23/067 |
| KR | 100271583 | B1 * | 11/2000 | F25D 23/04 |
| KR | 20020068929 | | 8/2002 | |
| NL | 6706574 | | 11/1967 | |
| WO | 9321487 | | 10/1993 | |
| WO | 98/08036 | | 2/1998 | |
| WO | 98/08037 | | 2/1998 | |
| WO | 2006011115 | | 2/2006 | |
| WO | 2008095776 | | 8/2008 | |
| WO | 2010/112296 | | 10/2010 | |
| WO | 2010112296 | | 10/2010 | |
| WO | WO-2010149537 | A2 * | 12/2010 | F25D 23/067 |

OTHER PUBLICATIONS

Translation for WO2008095776 (Year: 2008).*
International Search Report and Written Opinion issued in Application No. PCT/US2014/039310 dated Oct. 13, 2014.
International Search Report for PCT/BR2019/050165 dated Jan. 9, 2020, 2 pages.
EP communication in application No. 19723633.4, dated Jul. 12, 2023, 8 pages.

* cited by examiner

REFRIGERATING APPARATUS

FIELD OF THE INVENTION

The present invention relates generally to a refrigerating apparatus, and in particular to a refrigerating apparatus comprising accessories for the organized positioning of products to be refrigerated. More particularly, the present invention relates to a refrigerating apparatus comprising one or more support elements for supporting such accessories.

BACKGROUND ART

Each refrigerating apparatus typically comprises a refrigerating compartment and a door to allow selective access to the refrigerating compartment.

In most refrigerating apparatuses currently on the market, the door is typically provided, on an inner surface thereof that faces the refrigerating compartment when the door is closed, with an inner liner configured to mount accessories for the organized positioning of the products to be refrigerated (for example, shelves, drawers, bottle-holders, and the like).

For this purpose, the liner is provided with suitable assembly elements, typically obtained concurrently with the liner by known moulding techniques. Therefore, in most refrigerating apparatuses currently on the market, the accessories are essentially mounted in predefined positions, thus they do not allow obtaining user interfaces with adequate degree of modularity (i.e., configurability and/or re-configurability).

WO2016134987 discloses a refrigerating apparatus comprising a refrigerating compartment and a door for selectively closing the refrigerating compartment. The door comprises an external surface facing, when the door is closed, the external of the refrigerating compartment, and an inner liner, opposite to said external surface. The inner liner comprises first mechanic coupling elements coupled or coupleable to corresponding second mechanic coupling elements of a support panel of the refrigerating apparatus covering or adapted to cover at least partially the inner liner. The second mechanic coupling elements are located at a coupling region of the support panel facing said inner liner when the support panel covers the inner liner. The support panel comprises one or more support elements for supporting one or more storage elements adapted to store products to be refrigerated, the one or more support elements facing the refrigerating compartment when the support panel covers the inner liner and the door is closed.

SUMMARY OF THE INVENTION

The Applicant has noticed that, although the solution disclosed in WO2016134987 allows obtaining different positioning of the accessories (and therefore different user interfaces), issues of optimization of the space within the refrigerating compartment are still frustrating for a user.

In fact, according to the Applicant, the refrigerating apparatuses currently on the market do not allow the user to arrange the space within the refrigerating compartment in an orderly and organized manner. This involves that, typically, regions form in the refrigerating compartment that are essentially unused. This is the case, for example, of the regions below the shelves, especially when short food items are being stored.

The Applicant has faced the problem of obtaining refrigerating apparatuses with highly optimized space within the refrigerating compartment, so as to increase the food storage capacity of the refrigerating apparatuses while improving food organisation according to user needs.

The present invention is addressed to overcome the above-mentioned, as well as other, issues.

In particular, one or more aspects of the present invention are indicated in the independent claims, with advantageous features of the same invention that are indicated in the dependent claims, whose text is incorporated herein verbatim by reference.

More specifically, an aspect of the present invention proposes a refrigerating apparatus comprising:

- a refrigerating compartment delimited by a rear wall, and first and second side walls;
- a door for selectively closing the refrigerating compartment, the door facing the rear wall when the door is in a closed position;
- a support element within the refrigerating compartment for supporting at least one accessory for the organized positioning of products to be refrigerated, wherein the support element comprises a rail being a separate part adapted to be fixedly mounted to or fixedly associated with one of the first and second side walls so as to extend along said one of the first and second side walls, the rail being adapted to receive at least partially the at least one accessory and to hang it in a cantilevered manner whereby the at least one accessory is allowed to be freely positioned along said one of the first and second side walls in a cantilevered manner.

According to an embodiment of the present invention, the support element comprises a contact portion that, in use, is in contact with the at least one accessory, and a mounting portion that, in use, allows the support element to be fixedly mounted to or fixedly associated with said one of the first and second side walls. Preferably, the contact and mounting portions are, in use, parallel to said one of the first and second side walls and are preferably spaced apart from each other by a gap identifying said rail.

According to an embodiment of the present invention, the support element is fixedly mounted to said one of the first and second side walls of the refrigerating compartment. The support element preferably comprises coupling elements coupled or coupleable to corresponding coupling elements of said one of the first and second side walls for allowing said fixedly mounting of the support element to said one of the first and second side walls.

According to an embodiment of the present invention, said coupling elements of the support element are formed in a single piece with the mounting portion of the support element.

According to an embodiment of the present invention, the refrigerating apparatus further comprises a shelf adapted to be accommodated within the refrigerating compartment and having a shelf frame. The support element is preferably adapted to be fixedly associated with one of the first and second side walls by coupling of the support element to the shelf frame.

According to an embodiment of the present invention, the support element is formed in a single piece with the shelf frame.

According to an embodiment of the present invention, the mounting portion of the support element is formed in a single piece with a lower part of the shelf frame. Preferably, the support element extends underneath the shelf.

According to an embodiment of the present invention, the mounting portion of the support element is shaped such as to allow the support element to hang on the shelf frame.

According to an embodiment of the present invention, the shelf frame comprises first and second frame portions that in use face, respectively, the first and second side walls of the refrigerating compartment, the mounting portion of the support element preferably allowing the support element to hang on the first or second frame portion and to be retained, respectively, between the first or second side wall and the first or second frame portion.

According to an embodiment of the present invention, the shelf frame comprises first and second frame portions facing, in use, the rear wall and the door when the door is in the closed position, and first and second retaining portions formed in the first and second frame portions, preferably underneath the shelf. The mounting portion of the support element is preferably adapted to be fitted between the first and second retaining portions of the first and second frame portions.

According to an embodiment of the present invention, the mounting portion of the support element comprises an elongated bar adapted to be fitted between the first and second retaining portions of the first and second frame portions.

According to an embodiment of the present invention, said at least one accessory comprises at least one among a storage element for storing the products to be refrigerated and a retaining element for retaining storage bags.

According to an embodiment of the present invention, the door comprises a support panel covering or adapted to cover at least partially an inner liner of the door. Said support panel preferably comprises a further support element configured to support said at least one accessory.

According to an embodiment of the present invention, the further support element is configured to support said at least one accessory by hanging it on the at least on support element in a cantilevered manner.

According to an embodiment of the present invention, the at least one further support element and the support element have substantially same profiles, whereby the at least one accessory is allowed to be discretionally hung on the support element or on the further support element.

According to an embodiment of the present invention, the further support element comprises a contact portion that, in use, is in contact with the at least one accessory. Preferably, the contact portion of the further support element and the contact portion of the support element have substantially same profiles, whereby the at least one accessory is allowed to be discretionally hung on the support element or on the further support element.

Another aspect of the present invention relates to a refrigerating apparatus comprising:

- a refrigerating compartment delimited by a rear wall, and first and second side walls,
- a door for selectively closing the refrigerating compartment, the door facing the rear wall when the door is in a closed position, wherein the door comprises a support panel covering or adapted to cover at least partially an inner liner of the door,
- a support element within the refrigerating compartment for supporting at least one accessory for the organized positioning of products to be refrigerated, the support element being a separate part adapted to be mounted to or associated with one of the first and second side walls so as to extend along said one of the first and second side walls,
- a further support element provided in said support panel, wherein the support element and the further support element have substantially same profiles adapted to receive at least partially the at least one accessory and to hang it in a cantilevered manner, whereby the at least one accessory is allowed to be discretionally hung on the support element or on the further support element.

BRIEF DESCRIPTION OF THE FIGURE

One or more embodiments of the present invention, as well as further features and advantages thereof, will be better understood with reference to the following detailed description, given purely by way of non-limitative example only, to be read in conjunction with the accompanying figures (wherein corresponding elements are indicated with the same or similar references and their explanation is not repeated for the sake of brevity). In particular.

DESCRIPTION OF EMBODIMENTS OF THE INVENTION

Figure 1A:
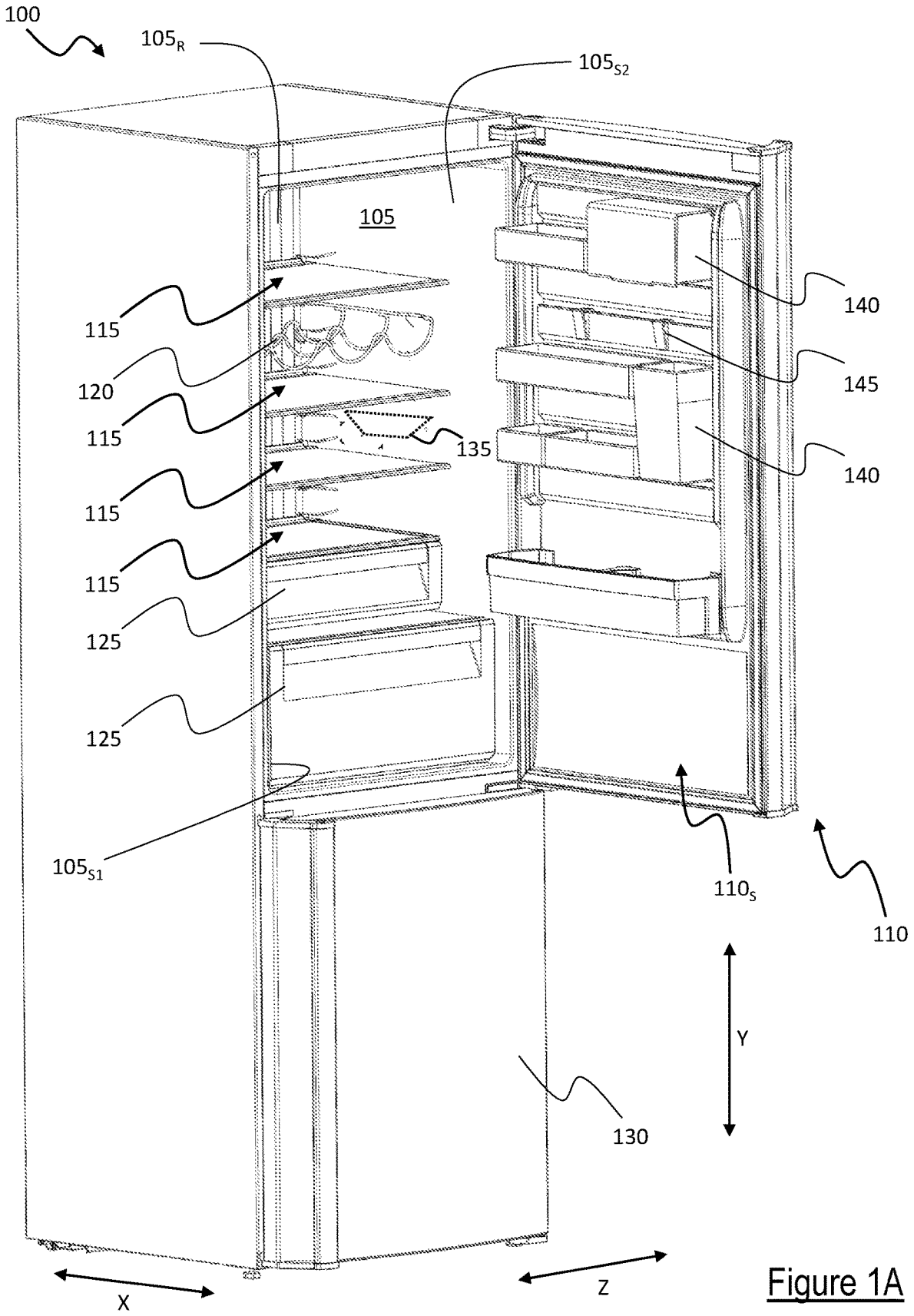
FIG. 1A shows a perspective view of a refrigerating apparatus according to the principles of the present invention.

With reference to FIG. 1A, it shows a perspective view of a refrigerating apparatus 100 according to the principles of the present invention. In the following, directional terminology (for example, upper, lower, side, left, right, longitudinal, vertical, transverse) associated with the refrigerating apparatus 100 and components thereof (for example, accessories for the organized positioning of the products to be refrigerated) will be used only in connection with their orientation in the figures, which is assumed to be their orientation of use (i.e., the orientation taken when the refrigerating apparatus 100 is installed in the user premises and the accessories mounted on it). Moreover, the term "substantially" will be used to take into account (desired or undesired) manufacturing tolerances.

The refrigerating apparatus 100 comprises a refrigerating compartment 105 (for example, a fridge compartment) for housing products to be refrigerated. The fridge compartment 105 is preferably delimited by a rear wall $\mathbf{105}_R$, and left $\mathbf{105}_{S1}$ and right $\mathbf{105}_{S2}$ side walls (in the following, the left $\mathbf{105}_{S1}$ and right $\mathbf{105}_{S2}$ side walls being globally referred to also as side walls $\mathbf{105}_{S1}$,$\mathbf{105}_{S2}$ or side wall side walls $\mathbf{105}_{S1}$, $\mathbf{105}_{S2}$, when distinguishing between them is not relevant).

Preferably, as herein assumed, the rear wall $\mathbf{105}_R$ extends along a vertical direction Y (taking the refrigerating apparatus 100 installed in the user premises as a reference, the refrigerating apparatus 100 has a height along the vertical direction Y), and, preferably, the side walls $\mathbf{105}_{S1}$, $\mathbf{105}_{S2}$ extend along the vertical direction Y parallel to each other and orthogonal to the rear wall $\mathbf{105}_R$. The refrigerating apparatus 100 further comprises a door 110 (shown in an open position) for selectively closing the fridge compartment 105, the door 110 facing the rear wall $\mathbf{105}_R$ (and, in the considered example, being parallel thereto) when the door 110 is in a closed position.

Preferably, the fridge compartment 105 comprises, within it, one or more accessories for the organized positioning of the products to be refrigerated, such as one or more shelves (such as the shelves 115 exemplary illustrated), and/or one or more bottle-holder components (such as the bottle-holder element 120 exemplary illustrated) and/or one or more drawers (such as the drawers 125 exemplary illustrated).

As will be better understood from the following discussion, embodiments of the present invention may be based on cooperation with the shelves 115 (or with properly modified versions thereof); in these embodiments, the presence of the bottle-holder element 120 and/or of the drawers 125 is optional (as being substantially irrelevant for the purposes of the present invention)—similarly, when considering embodiments of the present invention which are not based on cooperation with the shelves 115, with the bottle-holder element 120 or with the drawers 125, the presence of shelves 115, of the bottle-holder element 120 and/or of the drawers 125 should be considered as optional.

In the exemplary considered embodiment, the refrigerating apparatus 100 comprises a further refrigerating compartment (for example, a freezer compartment) and a door 130 associated with it (the freezer compartment being not visible in the figures as it is covered by the respective door 130 in the closed position). As will be apparent from the following description, the present invention can be applied to refrigerating apparatuses provided with any number of refrigerating compartments and doors—however, for the sake of exposition easy and brevity, the present invention will be exemplary discussed by making reference to the fridge compartment 105 and the associated door 110.

The refrigerating apparatus 100 further comprises one or more support elements 135 (e.g., made of a plastic material) mounted or mountable within the fridge compartment 105 for supporting further accessories for the organized positioning of the products to be refrigerated. In FIG. 1A, a single support element 135 is conceptually illustrated as a generic module (whose specific implementations will be detailed below) arranged between two adjacent shelves 115.

Examples of the accessories adapted to be supported by the support element 135 are storage elements—for example, tray storage elements (such as the tray storage elements 140 exemplary illustrated)—and/or retaining elements—for example, clip retaining elements (such as the clip retaining elements 145 exemplary illustrated) suitable to retain/hold storage bags, not shown. In the following, for the sake of exposition brevity, by storage/retaining elements 140,145 will be meant the tray storage elements 140 and/or the clip retaining elements 145.

The storage/retaining elements 140,145 are illustrated as hanging on a support panel covering or adapted to cover at least partially an inner liner of the door 110. The support panel is indicated in the figure by the number reference 110*s*, and is preferably the same as the support panel disclosed in WO2016134987 (and whose main features have been reported in the introductory part of this specification); this represents a particularly preferred and not limitative embodiment (better discussed in the following) in which the storage/retaining elements 140,145 are indistinctly used in connection with the support panel $\mathbf{110}_S$ associated with the door 110 or with the support element 135 within the fridge compartment 105.

As will be understood from the following discussion of exemplary embodiments of the present description, the positioning of the storage/retaining elements 140,145 within the fridge compartment 105 may define any arrangement or composition (in the following, user interface), and, according to specific implementations of the support element 135 and/or of the storage/retaining elements 140,145 this user interface has a predefined degree of modularity (i.e., configurability and/or re-configurability)—for example, the user interface may be fixed (i.e., pre-set by the manufacturer and not configurable or reconfigurable by the user), freely configurable and reconfigurable by the user, partially configurable by the user (for example, initially configurable by the user but not reconfigurable subsequently, or with only part of the user interface that may be configurable and/or reconfigurable).

Figure 1B:
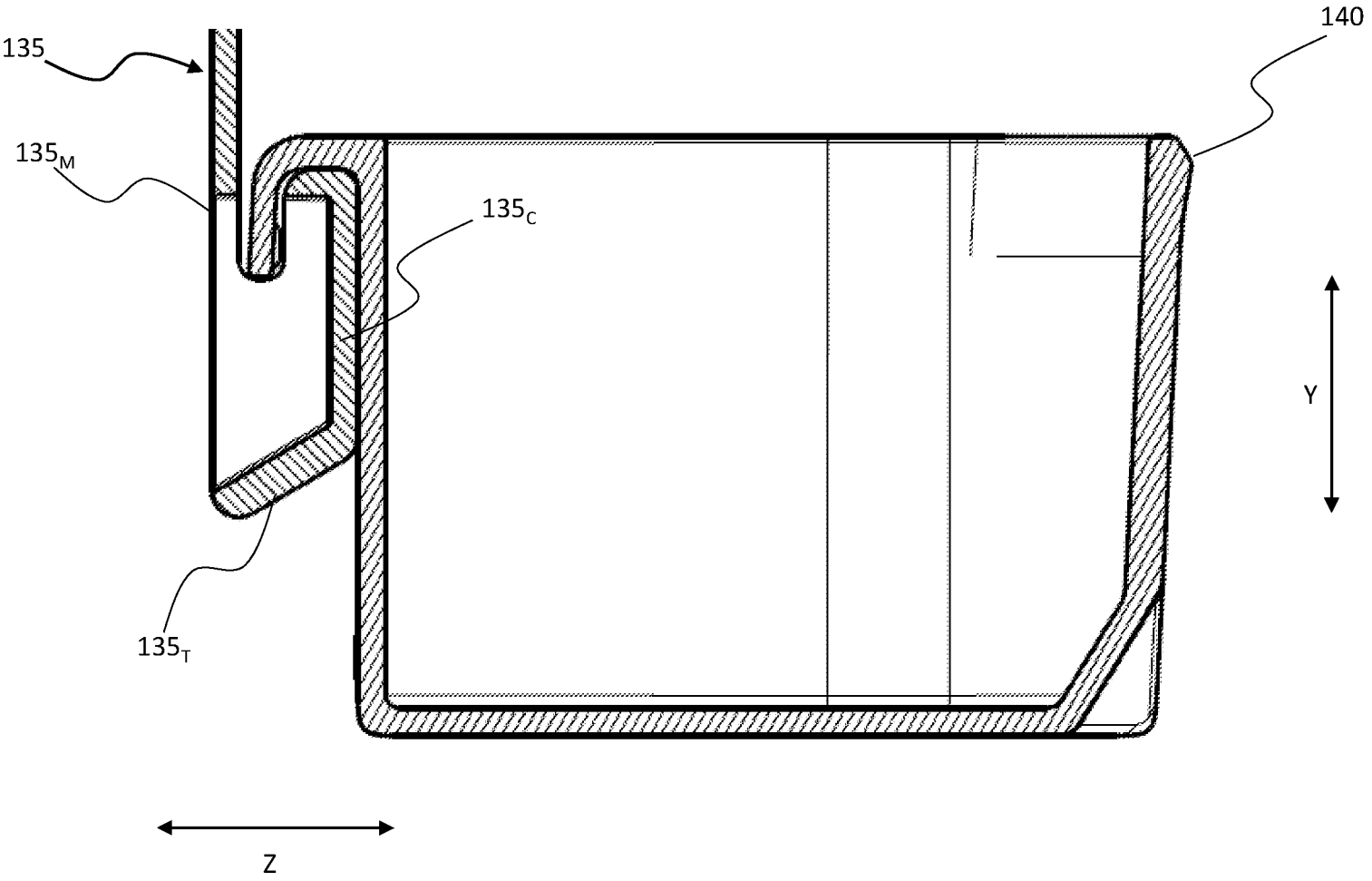
FIG. 1B shows a perspective view of a support element according to the principles of the present invention.

With reference also to FIG. 1B, it shows a perspective view of the support element 135 (with an exemplary storage element 140 hanging on it) according to the principles of the present invention.

The support element 135 preferably comprises or essentially defines a rail. Preferably, the support element 135 is a separate part adapted to be fixedly mounted to or fixedly associated with the side wall $\mathbf{105}_{S1}$ or the side wall $\mathbf{105}_{S2}$ (in the following, by side wall $\mathbf{105}_{S1}$,$\mathbf{105}_{S2}$ will be meant either the side wall $\mathbf{105}_{S1}$ or the side wall $\mathbf{105}_{S2}$ whereas by side walls $\mathbf{105}_{S1}$,$\mathbf{105}_{S2}$ will be meant both the side wall $\mathbf{105}_{S1}$ and the side wall $\mathbf{105}_{S2}$). As will be better understood from the following description, by support element 135 mounted to the side wall $\mathbf{105}_{S1}$,$\mathbf{105}_{S2}$ will be meant that the support element 135 is essentially directly fixed to the side wall $\mathbf{105}_{S1}$,$\mathbf{105}_{S2}$, whereas by support element 135 associated with the side wall $\mathbf{105}_{S1}$,$\mathbf{105}_{S2}$ will be meant that the support element 135, although being not fixed to the side wall $\mathbf{105}_{S1}$,$\mathbf{105}_{S2}$, is at or close to the side wall $\mathbf{105}_{S1}$,$\mathbf{105}_{S2}$ and extends along the side wall $\mathbf{105}_{S1}$,$\mathbf{105}_{S2}$. Moreover, by support element 135 fixedly mounted to or fixedly associated with the side wall $\mathbf{105}_{S1}$,$\mathbf{105}_{S2}$ will be meant that the support element 135, once mounted to or associated with the side wall $\mathbf{105}_{S1}$,$\mathbf{105}_{S2}$, is not movable (e.g., slideable) at user whish (although in certain embodiments a certain degree of movement of the support element 135 could also be allowed due to manufacturing and/or mounting tolerances).

In both cases of support element 135 mounted to and associated with the side wall $\mathbf{105}_{S1}$,$\mathbf{105}_{S2}$, the support element 135 advantageously extends, when it is mounted within the fridge compartment 105, along the side wall $\mathbf{105}_{S1}$,$\mathbf{105}_{S2}$ (i.e., in the example at issue of rear wall $\mathbf{105}_R$ parallel to the vertical direction and side walls $\mathbf{105}_{S1}$,$\mathbf{105}_{S2}$ parallel to each other and orthogonal to the rear wall $\mathbf{105}_R$, along a longitudinal direction X orthogonal to the vertical direction Y).

Preferably, the support element 135 (i.e., the rail defined by it) is adapted to receive at least partially one or more storage/retaining elements (such as the exemplary illustrated storage element 140, to which reference will be made from now on by way of example only). More preferably, as illustrated, the support element 135 is adapted to support the storage element by hanging it in a cantilevered manner, so as to allow free adjusting of its position along the longitudinal direction X by sliding (i.e., by sliding of the storage element 140 along the rail defined by the support element 135) along the side wall $\mathbf{105}_{S1}$ or the side wall $\mathbf{105}_{S2}$ in a cantilevered manner.

By hanging of the storage element 140 in a cantilevered manner is herein meant that the support element 135 supports the storage element 140 at a single side thereof; this is particularly advantageous over known solutions based on multiple support elements for a single storage element, which involve high complexity and costs (other than strongly reducing the availability of space within the fridge compartment).

Preferably, the support element 135 comprises a portion (hereinafter, contact portion) $\mathbf{135}_C$ that, in use, is in contact with the storage element 140, and a portion (hereinafter, mounting portion) $135_M$ that, in use, allows fixedly mounting the support element 135 within the fridge compartment 105 (i.e., fixedly mounting the support element 135 to the side wall $105_{S1}$,$105_{S2}$ or fixedly associating the support element 135 with the side wall $105_{S1}$,$105_{S2}$).

Preferably, the contact portion $135_C$ is substantially in the form of a plate and advantageously extends, in use, along the side wall $105_{S1}$,$105_{S2}$ (more particularly, the contact portion $135_C$ essentially lies on a plane parallel to the X-Y plane, or otherwise stated the contact portion $135_C$ is essentially parallel to the side walls $105_{S1}$,$105_{S2}$).

The mounting portion $135_M$ has been intentionally truncated in FIG. 1B, in that different implementations thereof may be envisaged depending on an adopted mounting mode (as discussed below).

In any case, the mounting portion $135_M$ preferably comprises (preferably, in all embodiments of the support element) a plate extending, in use, along the side wall $105_{S1}$, $105_{S2}$. More preferably, the mounting portion 135M is parallel to the contact portion $135_C$ (the mounting portion 135M thus essentially lying on a plane parallel to the X-Y plane, or otherwise stated the mounting portion 135M being essentially parallel to the side walls $105_{S1}$,$105_{S2}$), a lower end of the mounting portion $135_M$ (i.e. an end of the mounting portion $135_M$ that, in use, faces downwards along the vertical direction Y) being preferably connected to a lower end of the contact portion $135_C$ by means of a connecting portion $135_T$.

Even more preferably, the mounting portion $135_M$ is, with respect to the contact portion $135_C$, at a distance along a transverse direction Z, orthogonal to the longitudinal direction X and to the vertical direction Y; such a distance between the contact portion $135_C$ and the mounting portion $135_M$ essentially defines a gap that identifies the rail allowing the hooking and free positioning of the storage element 140 along the support element 135.

Preferably, as illustrated, an upper end of the contact portion $135_C$ (opposite to the lower end of the contact portion $135_C$) has a smoothed or substantially rounded profile for the hooking of the storage element 140—to this purpose, the storage element 140 is advantageously provided with a curved or arcuate arm adapted to act as a hook (however, any other shape of the storage element 140 may be foreseen to this purpose).

The mounting of the support element 135 within the fridge compartment 105 is not limitative for the present invention, since it can be chosen according to specific design needs or options. For example, the support element may be mounted within the fridge compartment 105 according to a first mounting mode, wherein the support element is coupled or coupleable to the side wall $105_{S1}$,$105_{S2}$ of the fridge compartment 105, or according to a second mounting mode, wherein the support element is coupled or coupleable to the shelf (preferably to a shelf frame, as better discussed in the following).

Depending on the adopted mounting mode, and on specific and different technicalities that can be adopted for implementing it, the support element may differ from the support element 135 illustrated only in a basic principle implementation. Specifically, the following FIGS. 2-5 show perspective and close-up views of support elements according to respective embodiments of the present invention (each figure also showing relevant portions of the refrigerating apparatus 100 being relevant for the understanding of the present invention).

Figure 2:
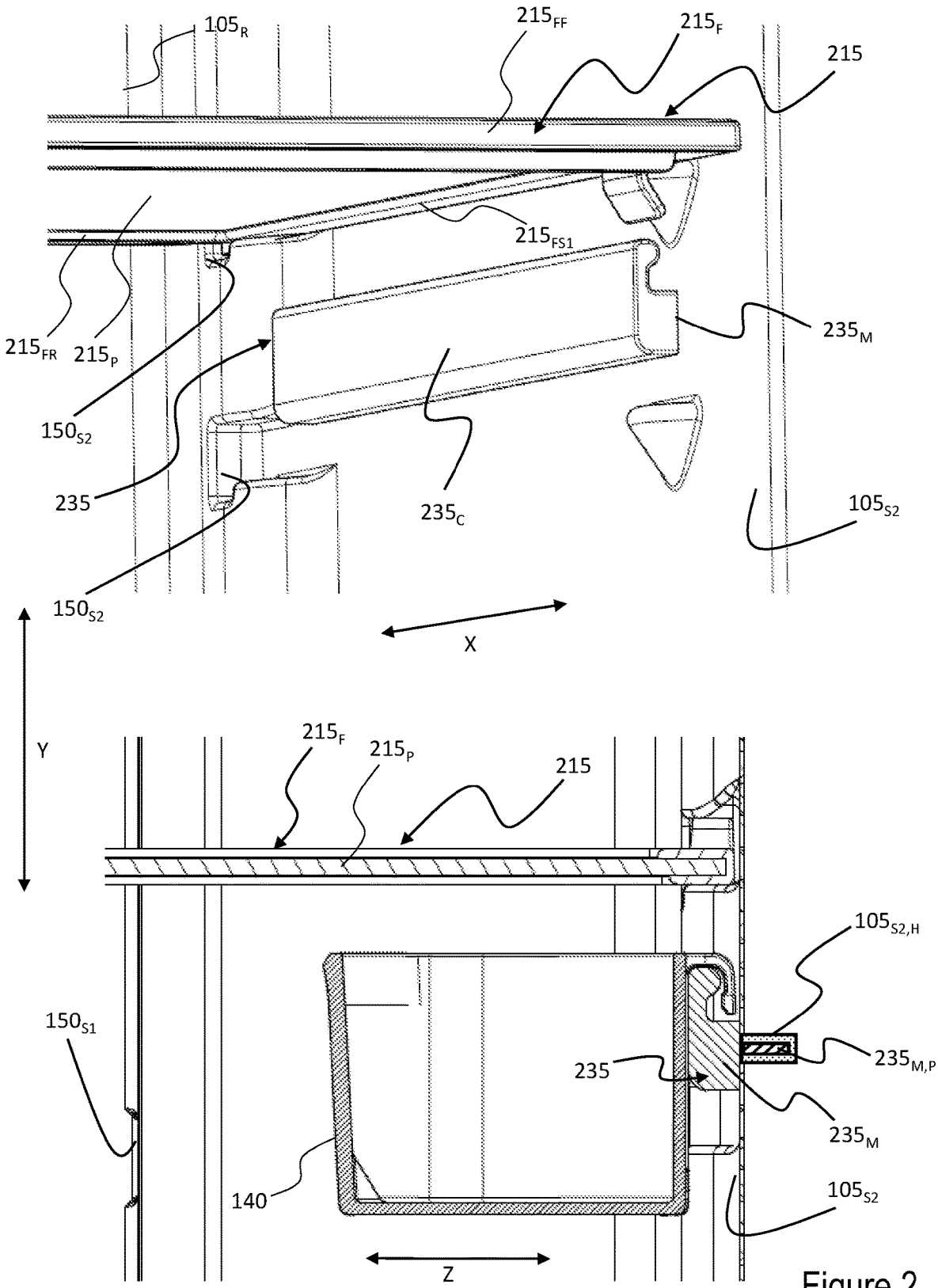
FIGS. 2-5 show perspective and close-up views of support elements according to embodiments of the present invention.

With reference first to FIG. 2, it shows a support element 235 coupled to one of the side walls $105_{S1}$,$105_{S2}$ of the refrigerating apparatus 100 (in the considered example, the side wall $105_{S2}$). Therefore, in this embodiment, the support element 235 is mounted within the fridge compartment 105 of the refrigerating apparatus 100 according to the first mounting mode.

In this embodiment, the side wall $105_{S1}$,$105_{S2}$ (preferably, bot side walls $105_{S1}$,$105_{S2}$) of the refrigerating apparatus 100 preferably comprise coupling elements coupled or coupleable to corresponding coupling elements of the support element 235. More preferably, the coupling elements of the side walls $105_{S1}$,$105_{S2}$ and the coupling elements of the support element 235 are coupleable to each other in a fixed and removable manner, so as to allow the support element 235 (and hence to the user interface it allows configuring) to be fixedly applied to the side wall $105_{S1}$,$105_{S2}$ in a reversible manner (and thus to be simply replaced).

Therefore, in this embodiment, the support element 235 is similar to the support element 135 of FIG. 1B, exception made for the presence of the coupling elements adapted to be coupled to the coupling elements of the side walls $105_{S1}$,$105_{S2}$.

The coupling elements (of the support element 235 and/or of the side walls $105_{S1}$,$105_{S2}$) may for example be mechanical and/or magnetic coupling elements. In the exemplary illustrated embodiment, the coupling elements are mechanical coupling elements.

The mechanical coupling elements may for example comprise snap fit elements. Alternatively, the mechanical coupling elements may comprise screws or pins adapted to be fitted into holes or threaded holes formed in the support element 235 and in the side wall $105_{S1}$,$105_{S2}$ (preferably, in both side walls $105_{S1}$,$105_{S2}$).

In the exemplary considered embodiment, the coupling elements of the support element 235 comprise one or more pins $235_{M,P}$ adapted to be fitted into respective seats or holes $105_{S1,H}$,$105_{S2,H}$ provided in the side walls $105_{S1}$,$105_{S2}$ (only the hole $105_{S2,H}$ provided in the side wall $105_{S2}$ being visible in FIG. 2), each pin $235_{M,P}$ being for example retained in the respective hole by friction. In alternative embodiments of the present invention, not shown, the pins may be provided in the side walls $105_{S1}$,$105_{S2}$ and the respective holes may be provided in the support element 235.

Advantageously, as illustrated, the pins $235_{M,P}$ are provided in the mounting portion $235_M$ of the support element 235, the pins $235_{M,P}$ being for example formed in a single piece with the mounting portion $235_M$. More advantageously, as illustrated, the pins $235_{M,P}$ are provided at a face of the mounting portion $235_M$ that, in use, faces (and preferably contacts) the side wall $105_{S1}$,$105_{S2}$ (the side wall $105_{S2}$ in the example at issue).

Advantageously, the pins $235_{M,P}$ (or other coupling element of the support element 235) and the holes $105_{S1,H}$, $105_{S2,H}$ (or other coupling element of the side wall $105_{S1}$, $105_{S2}$) are formed in fixed and predetermined positions. More advantageously, the holes $105_{S1,H}$,$105_{S2,H}$ (or other coupling element of the side wall $105_{S1}$, $105_{S2}$) are formed in a plurality of fixed and predetermined positions (i.e., with the support element 235 that can be mounted on the side wall $105_{S1}$ or on the side wall $105_{S2}$ and, for a selected side wall, at two or more different heights along the vertical direction Y or at different depths along the longitudinal direction X). In this way, it is possible to vary the user interface within the fridge compartment 105 in a simple way, and without changing the production process of the side walls $105_{S1}$, $105_{S2}$ (and in particular without replacing the mould used for the making thereof).

For the sake of completeness, a shelf 215 is also illustrated in FIG. 2.

Preferably, the shelf 215 comprises a shelf plate $\mathbf{215}_P$ and a shelf frame 215F.

The shelf plate $\mathbf{215}_P$, formed for example of a transparent plastic material or a tempered glass material, substantially forms, in use, the upper surface of the shelf 215 so that food can be safely seated on it. The shelf frame 215F, formed for example of a steel material or a plastic material, forms the frame of the shelf 215.

As exemplary illustrated, the shelf frame $\mathbf{215}_F$ may be a quadrangular frame corresponding to the shelf plate $\mathbf{215}_P$. Preferably, the shelf frame $\mathbf{215}_F$ comprises left $\mathbf{215}_{FS1}$ and right $\mathbf{215}_{FS2}$ side frame portions (only the right side frame portion $\mathbf{215}_{FS2}$ being visible in the figure) facing in use the side walls $\mathbf{105}_{S1}$,$\mathbf{105}_{S2}$, respectively, and adapted to be fitted (so as to allow the shelf 215 to be fitted) into respective guides $\mathbf{150}_{S1}$,$\mathbf{150}_{S2}$ formed in the side walls $\mathbf{105}_{S1}$,$\mathbf{105}_{S2}$, respectively: in order to achieve such a fitting, one or more snap-fit elements (not shown, and only partially visible in FIG. 4B) may be formed at an end of each side frame portion that, in use, is proximal to the rear wall $\mathbf{105}_R$ of the fridge compartment 105, each snap-fit element being for example adapted to allow said fitting in a reversible manner.

Preferably, the shelf frame $\mathbf{215}_F$ also comprises front $\mathbf{215}_{FF}$ and rear $\mathbf{215}_{FR}$ frame portions facing in use the door 110 in the closed position and the rear wall $\mathbf{105}_R$ of the fridge compartment 105, respectively (however as will be better understood when discussing embodiments of the second mounting mode, the front $\mathbf{215}_{FF}$ and rear $\mathbf{215}_{FR}$ frame portions are not essential or functional to such a second mounting mode, and may therefore be omitted in basic implementations).

Figure 3:
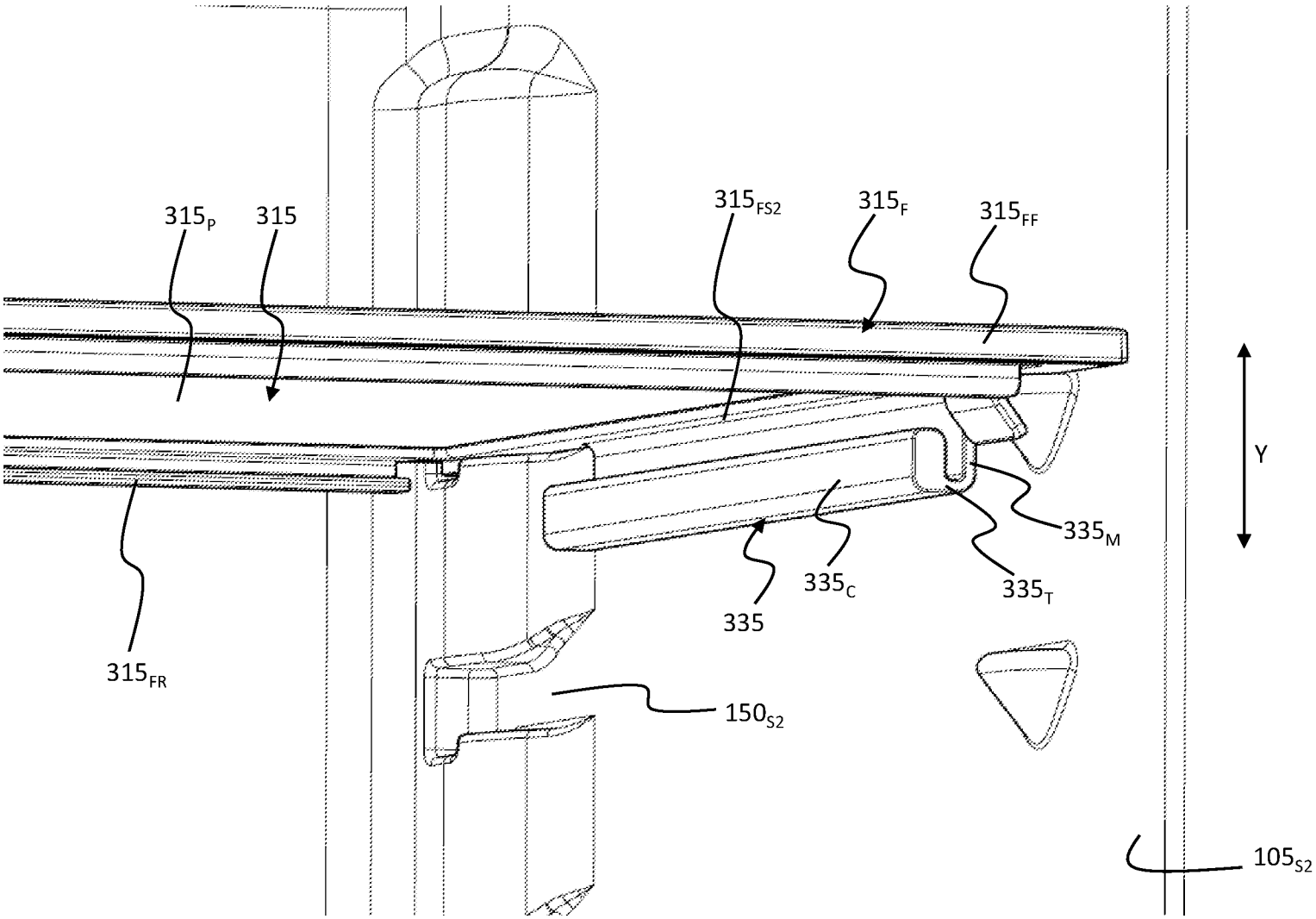

With reference to FIG. 3, it shows a support element 335 according to an embodiment of the present invention. In this embodiment, the support element 335 is adapted to be coupled to a shelf 315 (the support element 335 being thus adapted to be mounted within the fridge compartment 105 of the refrigerating apparatus 100 according to the second mounting mode).

Similarly to the shelf 215, the shelf 315 preferably comprises a shelf plate $\mathbf{315}_P$, formed for example of a transparent plastic material or a tempered glass material, and a shelf frame $\mathbf{315}_F$, formed for example of a steel material or a plastic material. Similarly to the shelf frame $\mathbf{215}_F$, the shelf frame $\mathbf{315}_F$ is preferably a quadrangular frame corresponding to the shelf plate $\mathbf{315}_P$, and preferably comprises left $\mathbf{315}_{FS1}$ and right $\mathbf{315}_{FS2}$ side frame portions (only the right side frame portion $\mathbf{315}_{FS2}$ being visible in the figure) facing in use the side walls $\mathbf{105}_{S1}$,$\mathbf{105}_{S2}$, respectively, and front $\mathbf{315}_{FF}$ and rear $\mathbf{315}_{FR}$ frame portions facing in use the door 110 in the closed position and the rear wall $\mathbf{105}_R$ of the fridge compartment 105, respectively.

In this embodiment, the support element 335 is formed in a single piece with the shelf frame $\mathbf{315}_F$.

Preferably, as illustrated, the mounting portion $\mathbf{335}_M$ of the support element 335 is formed in a single piece with a lower part of the shelf frame 315E that, in use, extends downwards. More preferably, the mounting portion $\mathbf{335}_M$ of the support element 335 is formed in a single piece with a lower part of the left frame portion $\mathbf{315}_{FS1}$ or of the right frame portion $\mathbf{315}_{FS2}$ that, in use, extends downwards. In this way, the support element 335 is associated with (i.e. it extends along and close to) the side wall $\mathbf{105}_{S1}$,$\mathbf{105}_{S2}$ (the side wall $\mathbf{105}_{S2}$ in the example at issue), and is placed (i.e. it extends) underneath the shelf 315: this addresses the issues of the known refrigerating apparatuses of unused or not optimally used regions that are located, underneath the shelf, close to the side walls of the refrigerating compartment.

In order to allow easy hanging of the storage/retaining elements (not shown) on the support element 335, the mounting portion $\mathbf{335}_M$ advantageously extends in height, i.e. along the vertical direction Y, over the contact portion $\mathbf{335}_C$ (i.e., over its upper end for the hooking of the storage/retaining elements). In this way, a user hanging one or more storage/retaining elements on the support element 335 experiences substantially no or at least reduced obstacle by the shelf 315.

Figure 4A:
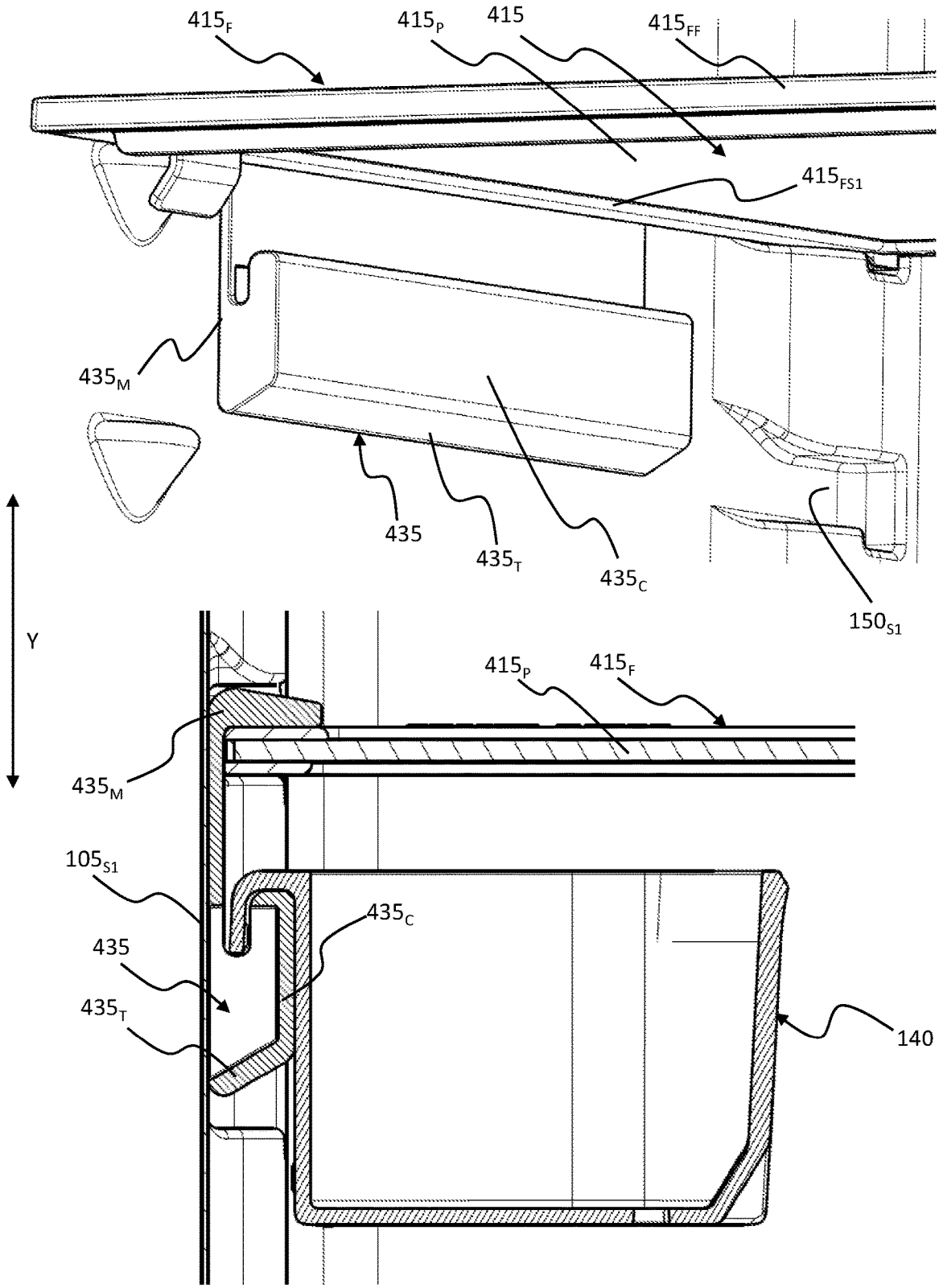
Figure 4B:
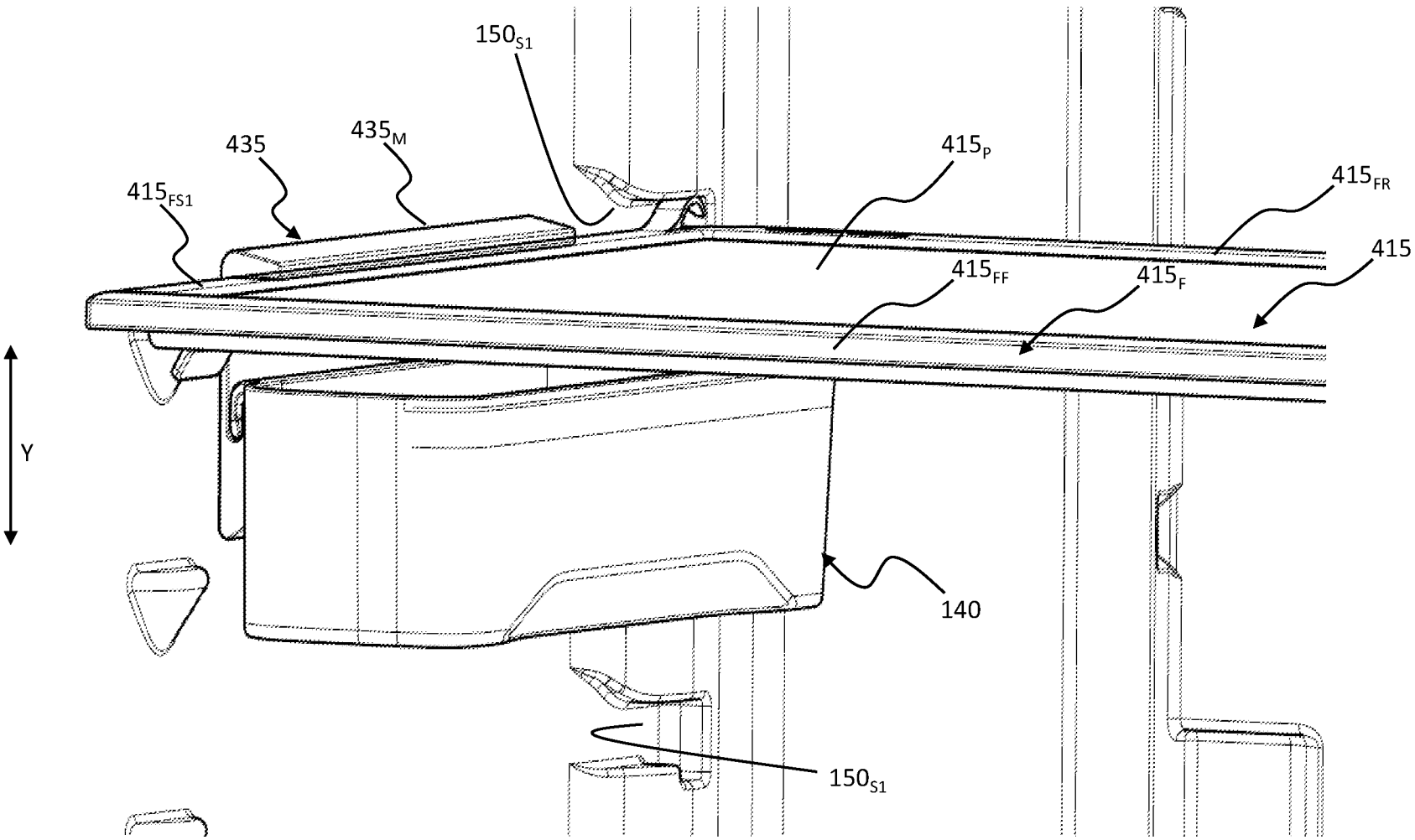

With reference to FIGS. 4A and 4B, they show a support element 435 according to another embodiment of the present invention. The support element 435 is adapted to be coupled to a shelf 415 (the support element 435 being thus adapted to be mounted within the fridge compartment 105 of the refrigerating apparatus 100 according to the second mounting mode).

Similarly to the above, the shelf 415 preferably comprises a shelf plate $\mathbf{415}_P$, formed for example of a transparent plastic material or a tempered glass material, and a shelf frame $\mathbf{415}_F$, formed for example of a steel material or a plastic material. Similarly to the above, the shelf frame $\mathbf{415}_F$ is preferably a quadrangular frame corresponding to the shelf plate $\mathbf{415}_P$ and preferably comprises left $\mathbf{415}_{FS1}$ and right $\mathbf{415}_{FS2}$ side frame portions (only the left side frame portion $\mathbf{415}_{FS1}$ being visible in the figure) facing in use the side walls $\mathbf{105}_{S1}$,$\mathbf{105}_{S2}$, respectively, of the fridge compartment 105, and front $\mathbf{415}_{FR}$ and rear $\mathbf{415}_{FR}$ frame portions facing in use the door 110 in the closed position and the rear wall $\mathbf{105}_R$ of the fridge compartment 105, respectively.

In this embodiment, the support element 435 has a contact portion $\mathbf{435}_C$ and a connecting portion $\mathbf{435}_T$ that are preferably analogous, respectively, to the contact portions $\mathbf{235}_C$, $\mathbf{335}_C$ and the connecting portions $\mathbf{235}_T$,$\mathbf{335}_T$.

In this embodiment, the support element 435 has a mounting portion $\mathbf{435}_M$ shaped such as to allow the support element 435 to hang on the shelf frame $\mathbf{415}_F$ (i.e. on the left $\mathbf{415}_{FS1}$ or right $\mathbf{415}_{FS2}$ side frame portions thereof, on the left side frame portion $\mathbf{415}_{FS1}$ in the example at issue).

Advantageously, in this embodiment, the mounting portion $\mathbf{435}_M$ allows the support element 435 to hang on the left $\mathbf{415}_{FS1}$ or right $\mathbf{415}_{FS2}$ side frame portions, and to be retained, respectively, between the left side frame portion $\mathbf{415}_{FS1}$ and the left side wall $\mathbf{105}_{S1}$ (as exemplary illustrated) or between the right side frame portion $\mathbf{415}_{FS2}$ and the right side wall $\mathbf{105}_{S2}$.

In order to achieve it, the mounting portion $\mathbf{435}_M$ of the support element 435 advantageously extends in height, i.e. along the vertical direction Y, over the contact portion $\mathbf{435}_C$ (i.e., over its upper end for the hooking of the storage/retaining elements). More advantageously, the mounting portion $\mathbf{435}_M$ of the support element 435 has a lower end that is connected to the lower end of the contact portion $\mathbf{435}_C$ by means of the connecting portion $\mathbf{435}_T$, and an upper end (opposite to the lower end) that extends in height over the contact portion $\mathbf{435}_C$ (i.e., its upper end) and substantially has an inverted-L profile. In particular, the inverted-L profile of the upper end of the mounting portion $\mathbf{435}_M$ essentially identifies a horizontal part of the mounting portion $\mathbf{435}_M$, parallel in use to the shelf 415 and defining an uppermost end of the mounting portion $\mathbf{435}_M$, and a vertical part, substantially orthogonal to the horizontal part, parallel in use to the side walls $\mathbf{105}_{S1}$,$\mathbf{105}_{S2}$. Preferably, the support element 435 is adapted to hang on a side shelf frame portion (for example, as illustrated, on the left side frame portion $415_{FS1}$) by means of the horizontal part of the mounting portion $435_M$, and to be kept in position by retention of the vertical part of the mounting portion $435_M$ between the side wall (the left side wall $105_{S1}$ in the example at issue) and the side frame portion facing it (i.e., the left side frame portion $415_{FS1}$).

Figure 5:
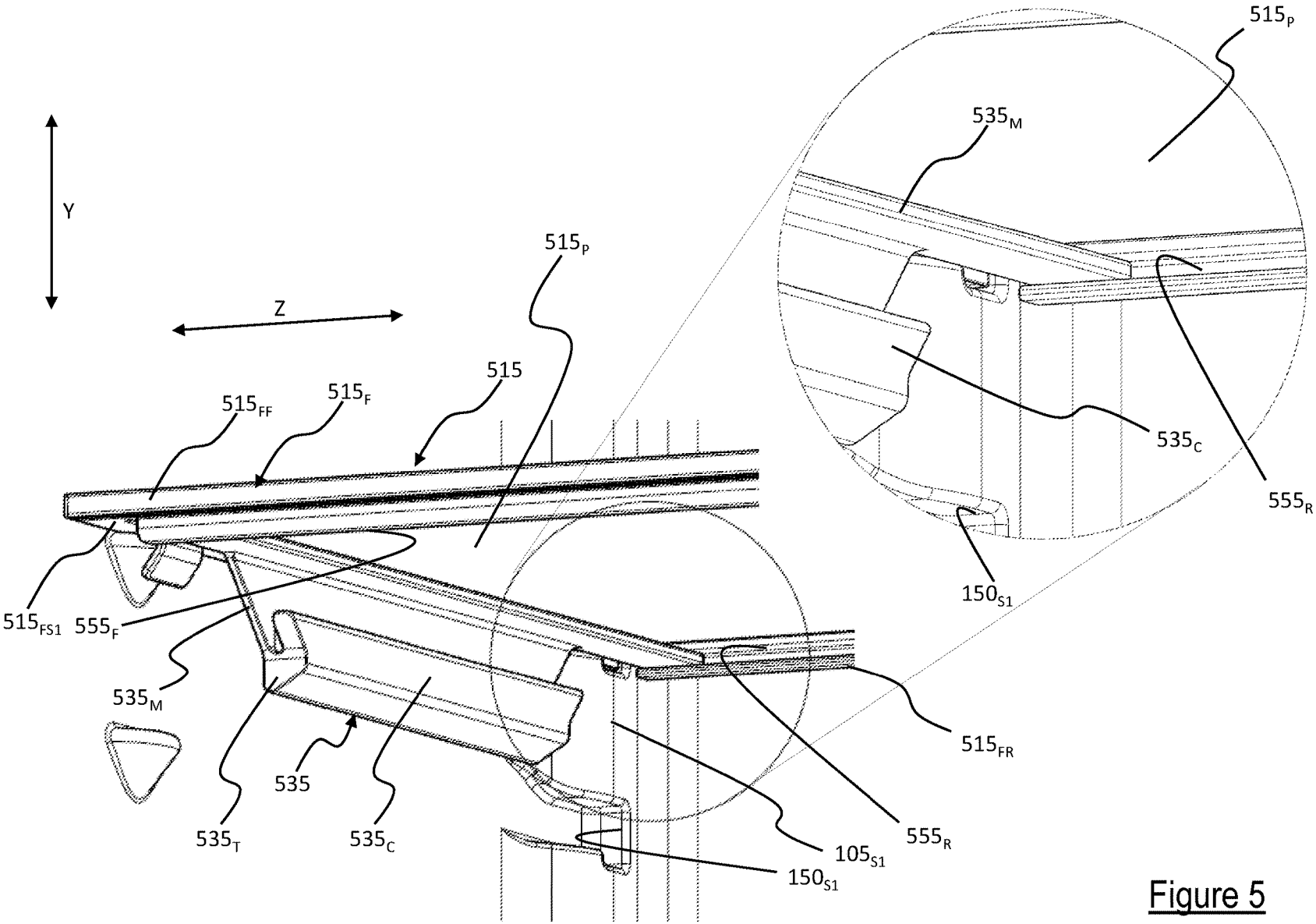

With reference to FIG. 5, it shows a support element 535 according to a further embodiment of the present invention. The support element 535 is adapted to be coupled to a shelf 515 (the support element 535 being thus adapted to be mounted within the fridge compartment 105 of the refrigerating apparatus 100 according to the second mounting mode).

Similarly to the above, the shelf 515 preferably comprises a shelf plate $515_P$, formed for example of a transparent plastic material or a tempered glass material, and a shelf frame $515_F$, formed for example of a steel material or a plastic material. Similarly to the above, the shelf frame $515_F$ is preferably a quadrangular frame, and comprises left $515_{FS1}$ and right $515_{FS2}$ side frame portions (only the left side frame portion $515_{FS1}$ being visible in the figure) facing in use the left $105_{S1}$ and right $105_{S2}$ side walls, respectively, and front $515_{FF}$ and rear $515_{FR}$ frame portions facing in use the door 110 in the closed position and the rear wall $105_R$ of the fridge compartment 105, respectively.

In this embodiment, the front $515_{FF}$ and rear $515_{FR}$ frame portions comprise respective retaining portions $555_F$,$555_R$ (hereinafter referred to as front $555_F$ and rear $555_R$ retaining portions) to retain the mounting portion $535_M$ (or at least a part thereof) of the support element 535. The front $555_F$ and rear $555_R$ retaining portions preferably extends underneath the shelf, the front $555_F$ and rear $555_R$ retaining portions preferably forming respective appendices of the front $515_{FF}$ and rear $515_{FR}$ frame portions.

More preferably, as illustrated, the front $555_F$ and rear $555_R$ retaining portions are in the form of recesses, e.g. C-shaped recesses, in the front $515_{FF}$ and rear $515_{FR}$ frame portions, respectively, the recesses facing each other such as to receive the support element 535 (or at least a parte thereof) therebetween (as better detailed here below). In the illustrated example, the recesses extend, along the transverse direction Z, for substantially all the width of the shelf 515, although this should not be construed limitatively (in fact, as discussed below, the recesses may advantageously have, along the transverse direction Z, a reduced extension compared to the width of the shelf 515).

In this embodiment, the support element 535 has a contact portion $535_C$ and a connecting portion 535T that are analogous, respectively, to the contact portions $235_C$,$335_C$,$435_C$ and the connecting portions $235_T$,$335_T$,$435_T$. In this embodiment, the support element 535 has a mounting portion 535*m* adapted to (e.g., shaped such as to) allow the support element 535 to be fitted into the recesses defined by the front $555_F$ and rear $555_R$ retaining portions (thus allowing the support element 535 to be supported and retained by them).

In order to achieve it the mounting portion $535_M$ of the support element 535 advantageously extends in height, i.e. along the vertical direction Y, over the contact portion $535_C$ (i.e., over its upper end for the hooking of the storage/retaining elements). More advantageously, the mounting portion $535_M$ of the support element 535 has a lower end that is connected to the lower end of the contact portion $535_C$ by means of the connecting portion 535T, and an upper end (opposite to the lower end) that extends in height over the contact portion $535_C$ (i.e., its upper end) and substantially has a T profile. In particular, the T profile of the upper end of the mounting portion $535_M$ essentially identifies a horizontal part of the mounting portion $535_M$, parallel in use to the shelf 515 and defining an uppermost end of the mounting portion $535_M$, and a vertical part, substantially orthogonal to the horizontal part, parallel in use to the side walls $105_{S1}$, $105_{S2}$ of the fridge compartment 105.

Preferably, the horizontal part of the mounting portion $535_M$ is in the form of an elongated bar. More preferably, the support element 535 is adapted to be fitted into the recesses defined by the front $555_F$ and rear $555_R$ retaining portions and to be retained therebetween (preferably, as illustrated, by fitting each end of the elongated bar into the recesses).

In order to prevent the elongated bar (and, hence, the support element 535) from sliding along the recesses, thus allowing the support element 535 to be fixedly associated with the side wall $105_{S1}$ (or the side wall $105_{S2}$), the recesses of the front $555_F$ and rear $555_R$ retaining portions and the ends of the elongated bar intended to be fitted therebetween house may have substantially same sizes along the transverse direction Z (in this embodiment, therefore, the ends of the elongated bar and the recesses have, along the transverse direction Z, a reduced extension compared to the width of the shelf 515).

Additionally or alternatively (and it is particularly advantageous in embodiments of the present invention in which, as illustrated, the recesses extend, along the transverse direction Z, for substantially all the width of the shelf 515), the retaining action of the front $555_F$ and rear $555_R$ retaining portions is provided by friction between the material of the front $555_F$ and rear $555_R$ retaining portions and the material of the elongated bar (or at least of the ends thereof). Just as an example, the material of the front $555_F$ and rear $555_R$ retaining portions and/or the material of the elongated bar (or at least of the ends thereof) may comprise, at least partially (e.g., superficially), one or more plastic with adherence properties, such as rubber or the like.

Figure 6:
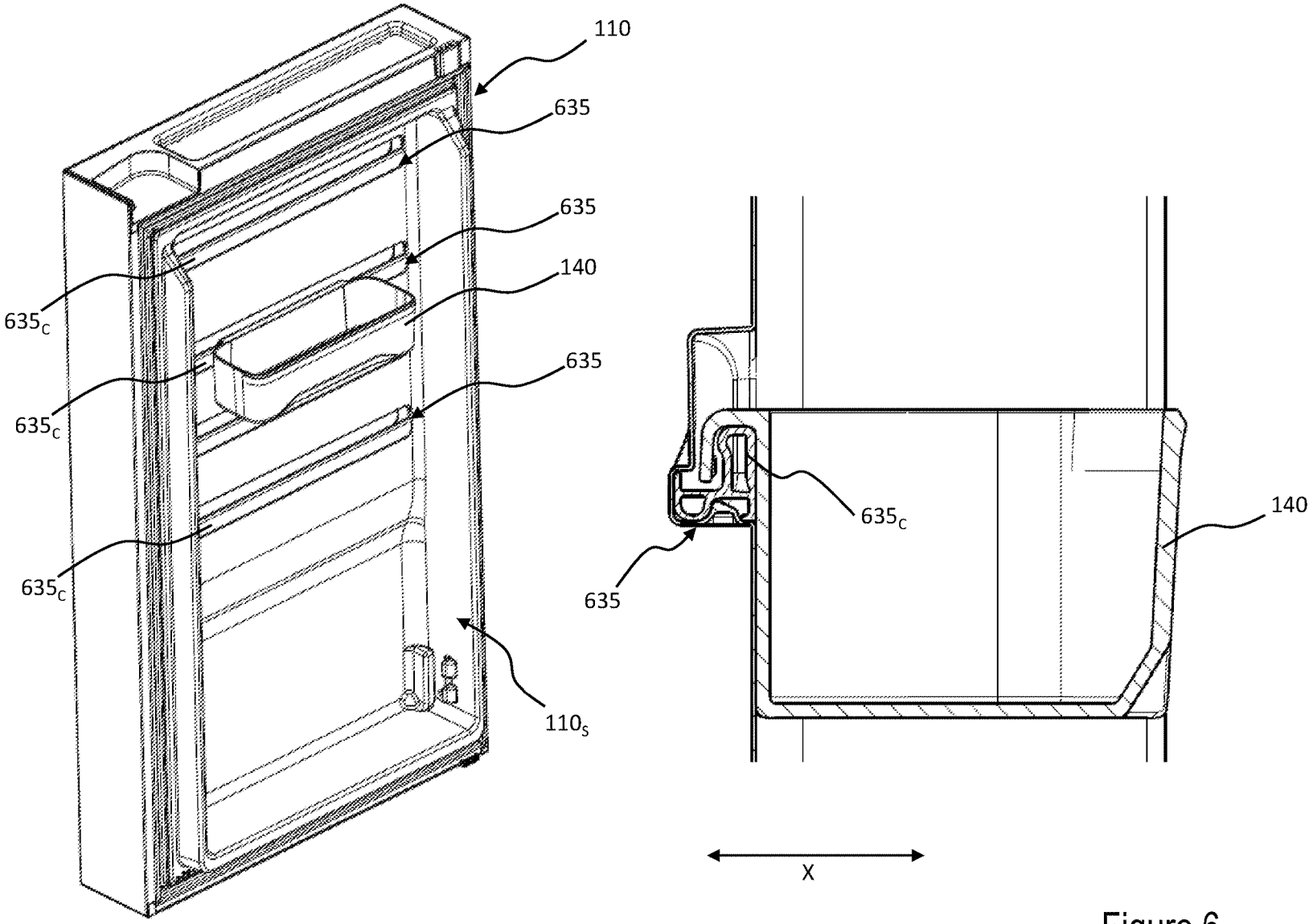
FIG. 6 shows a perspective view and a sectional view of the door of the refrigerating apparatus according to an embodiment of the present invention.

With reference to FIG. 6, it shows a perspective view (left drawing) and a sectional view (right drawing) of the door 110 of the refrigerating apparatus 100 according to an embodiment of the present invention. Differently from FIG. 1, and analogously to FIGS. 1B and 2-5, in FIG. 6 a single storage element 140 is exemplarily shown hanging on the support panel $110_S$.

As mentioned above, the support panel $110_S$ is preferably the same as the support panel disclosed in WO2016134987. For the purposes of the present disclosure, the support panel $110_S$ comprises one or more support elements 635 adapted to support the storage element 140 (or other storage/retaining element).

As visible in the figure, each support element 635 is adapted to support the storage element 140 by hanging it on the support element in a cantilevered manner.

In order to achieve it, each support element 635 of the support panel $110_S$ is preferably in the form of a rail. Preferably, as can be better appreciated in the sectional view of FIG. 6, each support element 635 has a contact portion $635_C$ that, in use, is in contact with the storage element 140; moreover, in the illustrated example, the contact portion $635_C$ is arranged at a such distance (along the longitudinal direction X, considering the door 110 in the closed position) from the inner liner of the door 110 that a gap is defined for allowing the hooking and free positioning of the storage element 140 along the support element 635 (the gap between the contact portion $635_C$ of the support element 635 and the inner liner of the door 110 thus identifying the rail).

According to a particularly preferred embodiment of the present invention, the support element 635 (particularly, the contact portion $635_C$ thereof) and the support element 135,

235,335,435,535 (particularly, the contact portion $\mathbf{135}_C$, $\mathbf{235}_C$,$\mathbf{335}_C$,$\mathbf{435}_C$,$\mathbf{535}_C$ thereof) have substantially same profiles (adapted to receive at least partially the storage element 140 and to hang it in a cantilevered manner), whereby the storage element 140 is allowed to be discretionally hung on the support element 135;235;335;435;535 within the fridge compartment 105 or on the support element 635 on the door 110.

Naturally, in order to satisfy local and specific requirements, a person skilled in the art may apply to the present invention many logical and/or physical modifications and alterations. More specifically, although the present invention has been described with a certain degree of particularity with reference to one or more embodiments thereof, it should be understood that various omissions, substitutions and changes in the form and details as well as other embodiments are possible. Particularly, different embodiments of the invention may even be practiced without the specific details; conversely, well-known features may have been omitted or simplified in order not to obscure the description with unnecessary particulars. Moreover, it is expressly intended that specific elements described in connection with any embodiment of the disclosed invention may be incorporated in any other embodiment as a matter of general design choice.

The invention claimed is:

1. Refrigerating apparatus comprising:

a refrigerating compartment delimited by a rear wall, and first and second side walls, a door for selectively closing the refrigerating compartment, the door facing the rear wall when the door is in a closed position, a support element within the refrigerating compartment configured to support at least one accessory that is configured to organize and position products to be refrigerated, wherein the support element comprises a rail being a separate part adapted to be fixedly mounted to one of the first and second side walls so as to extend along said one of the first and second side walls, the rail being adapted to receive at least partially the at least one accessory and to hang it in a cantilevered manner whereby the at least one accessory is allowed to be freely positioned along said one of the first and second side walls in a cantilevered manner, wherein the support element further comprises first coupling elements of the rail that are coupleable to corresponding second coupling elements which are non-removably secured to said one of the first or second side walls, wherein the rail of the support element is removable from said one of the first or second side walls via selective disengagement of the first coupling elements and the second coupling elements, wherein the door comprises a support panel covering or adapted to cover at least partially an inner liner of the door, and wherein said support panel comprises a further support element configured to support said at least one accessory, wherein the at least one further support element and the support element have substantially same profiles, whereby the at least one accessory is allowed to be discretionally hung on the support element or on the further support element, and the further support element is integrally built into the support panel of the door.

2. The refrigerating apparatus according to claim 1, wherein the support element comprises a contact portion that, in use, is in contact with the at least one accessory, and a mounting portion that, in use, allows the support element to be fixedly mounted to or fixedly associated with said one of the first and second side walls, the contact and mounting portions being, in use, parallel to said one of the first and second side walls and being spaced apart from each other by a gap identifying said rail.

3. The refrigerating apparatus according to claim 1, wherein the support element is fixedly mounted to said one of the first and second side walls of the refrigerating compartment via engagement between the first coupling elements and the second coupling elements.

4. The refrigerating apparatus according to claim 2, wherein said first coupling elements of the support element are formed in a single piece with the mounting portion of the support element.

5. The refrigerating apparatus according to claim 1, wherein said at least one accessory comprises at least one among a storage element for storing the products to be refrigerated and a retaining element for retaining storage bags.

6. The refrigerating apparatus according to claim 1, wherein the further support element is configured to support said at least one accessory by hanging it on the further support element in a cantilevered manner.

7. The refrigerating apparatus according to claim 1, wherein the further support element comprises a contact portion that, in use, is in contact with the at least one accessory, the contact portion of the further support element and a contact portion of the support element having substantially same profiles.

8. Refrigerating apparatus comprising:

a refrigerating compartment delimited by a rear wall, and first and second side walls, a door for selectively closing the refrigerating compartment, the door facing the rear wall when the door is in a closed position, wherein the door comprises a support panel covering or adapted to cover at least partially an inner liner of the door, a support element within the refrigerating compartment configured to support at least one accessory that is configured to organize and position products to be refrigerated, the support element being a separate part adapted to be mounted to or associated with one of the first and second side walls so as to extend along said one of the first and second side walls, a further support element provided in said support panel, wherein the support element and the further support element have substantially same profiles adapted to receive at least partially the at least one accessory and to hang it in a cantilevered manner, whereby the at least one accessory is allowed to be discretionally and removably hung on the support element or on the further support element, wherein the support element is removable from said one of the first or second side walls by selective disengagement of first coupling elements of the support element and second coupling elements of one of the first or second side walls, and wherein the further support element is integrally built into the support panel of the door.

* * * * *